US006792076B2

(12) United States Patent
Petach et al.

(10) Patent No.: US 6,792,076 B2
(45) Date of Patent: Sep. 14, 2004

(54) TARGET STEERING SYSTEM FOR EUV DROPLET GENERATORS

(75) Inventors: Michael B. Petach, Redondo Beach, CA (US); Steven W. Fornaca, Torrance, CA (US); Rocco A. Orsini, Long Beach, CA (US)

(73) Assignee: Northrop Grumman Corporation, Redondo Beach, CA (US)

( * ) Notice: Subject to any disclaimer, the term of this patent is extended or adjusted under 35 U.S.C. 154(b) by 47 days.

(21) Appl. No.: 10/157,222

(22) Filed: May 28, 2002

(65) Prior Publication Data

US 2003/0223541 A1 Dec. 4, 2003

(51) Int. Cl.[7] ..... H01J 35/00
(52) U.S. Cl. ..... 378/119; 378/143
(58) Field of Search ..... 378/119, 143

(56) References Cited

U.S. PATENT DOCUMENTS

| | | | | |
|---|---|---|---|---|
| 4,723,262 A | | 2/1988 | Noda et al. | 378/119 |
| 5,577,091 A | * | 11/1996 | Richardson et al. | 378/119 |
| 5,577,092 A | | 11/1996 | Kublak et al. | 378/119 |
| 6,002,744 A | | 12/1999 | Hertz et al. | 378/119 |
| 6,324,256 B1 | | 11/2001 | McGregor et al. | 378/119 |
| 6,377,651 B1 | | 4/2002 | Richardson et al. | 378/34 |

OTHER PUBLICATIONS

Rymell, L., Berglund, M., Hansson, B.A.M. & Hertz, H.M., "X–ray and EUV laser–plasma sources based on cryogenic liquid–jet target", SPIE vol. 3676, Mar. 1999, pp. 421–424.

Gouge, M.J. & Fisher, P.W., "A cryogenic xenon droplet generator for use in a compact laser plasma x–ray source", Rev. Sci. Instrum., vol. 68, No. 5, May 1997, pp. 2158–2162.

Torres, D., Jin, F., Richardson, M. & DePriest, C., "Characterization of mass–limited ice droplet laser plasmas", OSA Trends in Optics and Photonics, vol. IV, Extreme Ultraviolet Lithography, 1996, pp. 75–79.

Malmquist, L., Rymell, L. & Hertz, H.M., "High–repetition–rate droplet target for laser–plasma EUV generation", OSA Trends in Optics and Photonics, vol. IV, Extreme Ultraviolet Lithography, 1996, pp. 72–74.

Jin, F., Richardson, M.C., Shimkaveg, G.M. and Torres, D., "Characterization of a Laser Plasma Water Droplet EUV Source", Proceedings of SPEI, vol. 2523, 1995, pp. 81–87.

Rymell, L. and Hertz, H.M., "Droplet Target for Low–debris Laser–plasma Soft X–ray Generation", Optics Communications, vol. 103, 1993, pp. 105–110.

Heinzel, J. and Hertz, C.H., "Ink–jet Printing", Advances in Electronics and Electron Physics, Ed. by P.W. Hawkes, vol. 65, 1985, pp. 91–141.

Tanimoto, M., "Cryogenic Experimental Device for Production of Solid Pellets", Proceedings of 7th Symposium on Fusion Technology, Grenoble, 1972.

European Search Report re: counterpart application No. EP 03 01 1056.

* cited by examiner

*Primary Examiner*—Craig E Church
*Assistant Examiner*—Jurie Yun
(74) *Attorney, Agent, or Firm*—Harness, Dickey & Pierce, P.L.C.

(57) ABSTRACT

An EUV radiation source (50) that employs a steering device (74) for steering a stream (66) of droplets (68) generated by a droplet generator (52) so that the droplet (68) are directed towards a target location (76) to be vaporized by a laser beam (78). The direction of the stream (66) of droplets (68) is sensed by a sensing device (84). The sensing device (84) sends a signal to an actuator (88) that controls the orientation of the steering device (74) so that the droplets (68) are directed to the target location (76).

18 Claims, 1 Drawing Sheet

TARGET STEERING SYSTEM FOR EUV DROPLET GENERATORS

BACKGROUND OF THE INVENTION

1. Field of the Invention

This invention relates generally to an EUV radiation source and, more particularly, to an EUV radiation source that employs a target steering device to accurately steer the target droplets to the target vaporization area.

2. Discussion of the Related Art

Microelectronic integrated circuits are typically patterned on a substrate by a photolithography process, well known to those skilled in the art, where the circuit elements are defined by a light beam propagating through a mask. As the state of the art of the photolithography process and integrated circuit architecture becomes more developed, the circuit elements become smaller and more closely spaced together. As the circuit elements become smaller, it is necessary to employ photolithography light sources that generate light beams having shorter wavelengths and higher frequencies. In other words, the resolution of the photolithography process increases as the wavelength of the light source decreases to allow smaller integrated circuit elements to be defined. The current state of the art for photolithography light sources generate light in the extreme ultraviolet (EUV) or soft x-ray wavelengths (13–14 nm).

U.S. patent application Ser. No. 09/644,589, filed Aug. 23, 2000, entitled "Liquid Sprays as a Target for a Laser-Plasma Extreme Ultraviolet Light Source," and assigned to the assignee of this application, discloses a laser-plasma, EUV radiation source for a photolithography system that employs a liquid as the target material, typically xenon, for generating the laser plasma. A xenon target material provides the desirable EUV wavelengths, and the resulting evaporated xenon gas is chemically inert and is easily pumped out by the source vacuum system. Other liquids and gases, such as krypton and argon, and combinations of liquids and gases, are also available for the laser target material to generate EUV radiation.

The EUV radiation source employs a source nozzle that generates a stream of target droplets. The droplet stream is created by forcing a liquid target material through an orifice (50–100 microns diameter), and perturbing the flow by voltage pulses from an excitation source, such as a piezoelectric transducer, attached to a nozzle delivery tube. Typically, the droplets are produced at a high rate (10–100 kHz) at the Rayleigh instability break-up frequency of a continuous flow stream. The droplets may be emitted from the nozzle into a vacuum, where rapid evaporation and freezing of the droplets will result, or they may be ejected into a buffer gas at an appropriate pressure and temperature to control the rate of evaporation of the droplets.

To meet the EUV power and dose control requirements for next generation commercial semiconductors manufactured using EUV photolithography, the laser beam source must be pulsed at a high rate, typically 5–10 kHz. It therefore becomes necessary to supply high-density droplet targets having a quick recovery of the droplet stream between laser pulses, such that all laser pulses interact with target droplets under optimum conditions. This requires a droplet generator which produces droplets within 100 microseconds of each laser pulse.

Droplet generators, including downstream differentially pumped cavities, are relatively massive and employ many connections for coolant, vacuum and electrical lines. Thus, weight and configuration constraints make the droplet generator difficult to position, and consequently severely limits its positioning response time. Further, the orientation of the droplet generator relative to the target location may be required to be off axis.

SUMMARY OF THE INVENTION

In accordance with the teachings of the present invention, an EUV radiation source is disclosed that employs a steering device for steering a droplet stream generated by a droplet generator to a target area. The droplet generator directs the stream of droplets in a certain direction that is sensed by a position sensor. The sensed position of the droplet stream is sent to an actuator that controls the orientation of the steering device. The droplet stream impinges the steering plate and is deflected therefrom towards the target area.

Additional objects, advantages and features of the present invention will become apparent from the following description and appended claims, taken in conjunction with the accompanying drawings.

DETAILED DISCUSSION OF THE EMBODIMENTS

The following discussion of the embodiments of the invention directed to an EUV radiation source employing a steering plate is merely exemplary in nature, and is in no way intended to limit the invention or its applications or uses.

Figure 1:
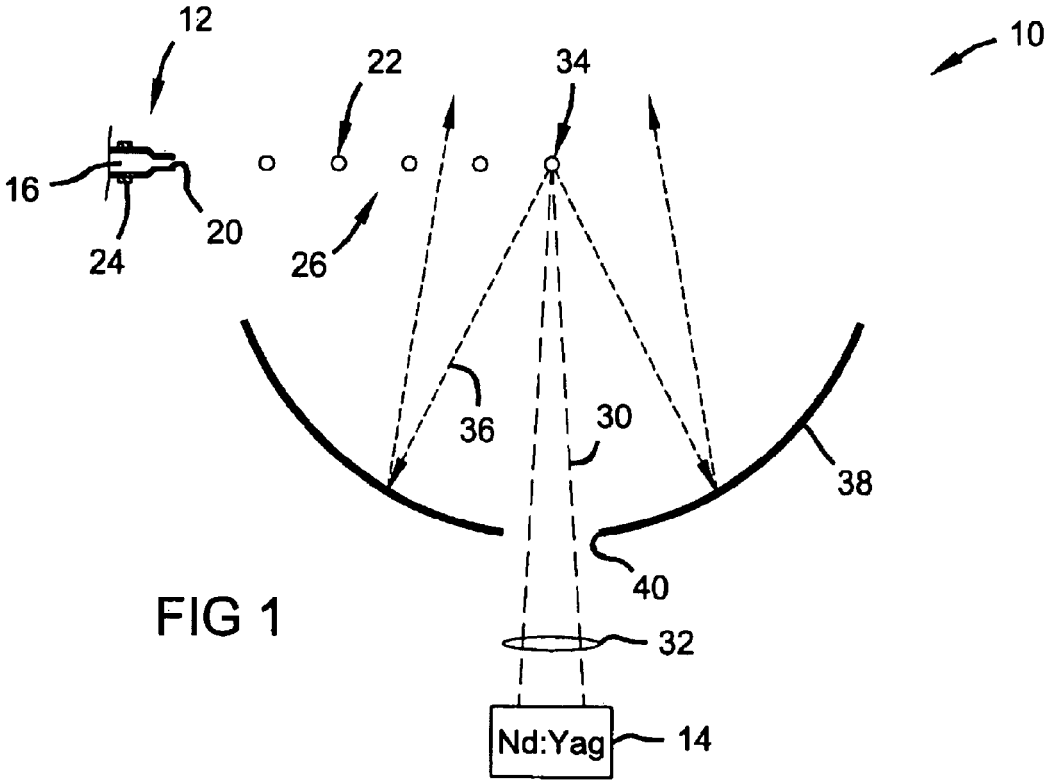
FIG. 1 is a plan view of an EUV radiation source.

FIG. 1 is a plan view of an EUV radiation source 10 including a nozzle 12 and a laser beam source 14. A liquid 16, such as xenon, flows through the nozzle 12 from a suitable source. The liquid 16 is forced under pressure through an exit orifice 20 of the nozzle 12 where it is formed into a stream 26 of liquid droplets 22 directed to a target location 34. A piezoelectric transducer 24 positioned on the nozzle 12 perturbs the flow of liquid 16 to generate the droplets 22.

A laser beam 30 from the source 14 is focused by focusing optics 32 onto the droplet 22 at the target location 34, where the source 14 is pulsed relative to the rate of the droplets 22 as they reach the target location 34. The heat from the laser beam 30 vaporizes the droplet 22 and generates a plasma that radiates EUV radiation 36. The EUV radiation 36 is collected by collector optics 38 and is directed to the circuit (not shown) being patterned. The collector optics 38 can have any suitable shape for the purposes of collecting and directing the radiation 36. In this design, the laser beam 30 propagates through an opening 40 in the collector optics 38, however, other designs employ different collector optics designs. The plasma generation process is performed in a vacuum.

The orientation of the nozzle 12 relative to the target location 34 is provided in the radiation source 10 so that the stream 26 of droplets 22 are directed straight to the target location 34. However, in practical systems, it is difficult to orient the nozzle 12 relative to the collector optics 38 so that the droplets 22 are directed exactly to the target location 34. Further, system operating parameters sometimes cause the droplets 22 to be emitted from the nozzle 12 along slightly different paths. Further, in some designs, the orientation of the nozzle relative to the target location is specifically designed to be off-axis.

Figure 2:
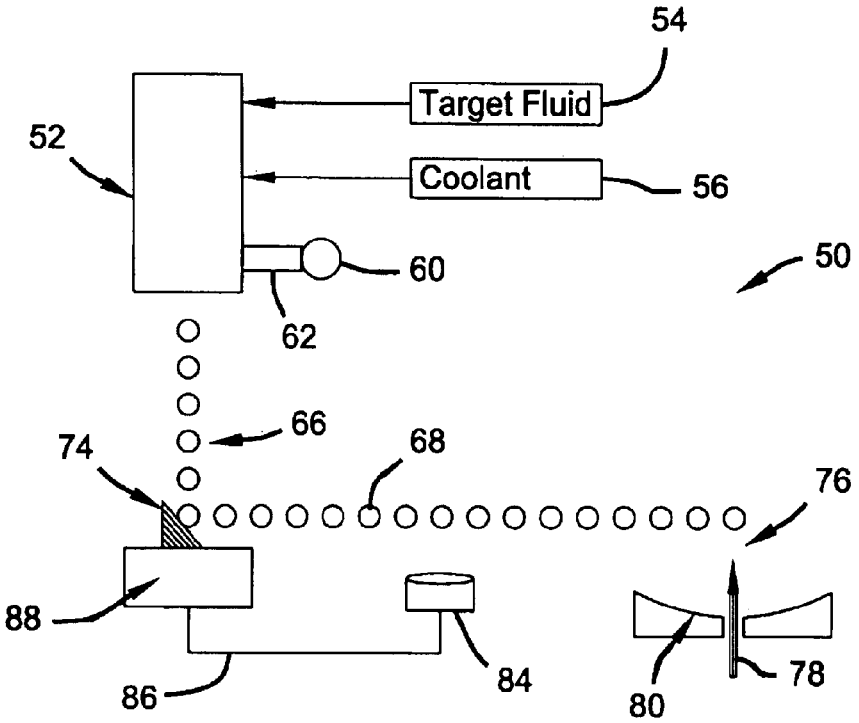
FIG. 2 is another plan view of an EUV radiation source employing a droplet stream steering plate, according to an embodiment of the present invention.

FIG. 2 is a plan view of an EUV radiation source 50, according to an embodiment of the present invention. The source 50 includes a droplet generator 52 that receives a target material, such as liquid xenon, from a source 54. The nozzle 12 discussed above would be the type of nozzle provided within the droplet generator 52 to generate the droplets. The droplet generator 52 is shown generally because its specific configuration is not important to the present invention, and thus is intended to represent any droplet generator suitable for the purposes described herein.

Because the target material is typically a gas at room temperature and pressure, the target material is chilled, for example, by liquid nitrogen, to put it in the liquid state. A coolant from a coolant source 56 is applied to the droplet generator 52 to maintain the target material in the liquid state within the generator 52. Further, the droplet generator 52 is maintained in a vacuum to limit the gases which may interact with the droplet formation process. A pump 60 is connected to a pump output port 62 of the generator 52 so that gases within the generator 52 can be removed.

The droplet generator 52 generates a stream 66 of droplets 68. The droplets 68 have a predetermined spacing and size for the EUV radiation generation process, as would be well understood to those skilled in the art. As discussed above, the droplets 68 are emitted into a vacuum, or a low pressure chamber, where the droplets 68 begin to evaporate, condense and freeze to the desirable size.

In this example, the stream 66 is directed from the droplet generator 52 off-axis relative to the source target location. In order to redirect the stream 66 so it is properly oriented relative to the target location, a reflective steering plate 74 is provided, according to the invention. The steering plate 74 can be any suitable reflective surface or device that causes the droplets 68 to be deflected therefrom. By the time the droplets 68 reach the steering plate 74, they are substantially frozen as a result of their low temperature and the low pressure source environment so that the droplets 68 are easily deflected therefrom.

In this example, the steering plate 74 is positioned so that the stream 66 and the droplets 68 are deflected substantially 90° from their original path. The stream 66 is redirected by the steering plate 74 so that the droplets 68 pass through a target location 76, where a laser beam 78 strikes the target droplet 68 as it enters the target location 76. Further, the target location 76 is at the focal point of primary collecting optics 80.

To determine that the stream 66 is directed to the target location 76, a position sensor 84 is located at a strategic location along the stream 66. Any type of sensor capable of sensing frozen droplets and suitable for an EUV radiation source can be used. The sensor 84 sends an electrical signal on line 86 back to a steering plate actuator 88 that adjusts the orientation of a steering plate 74 so that the direction of the stream 66 is corrected. Thus, the position sensor 84 senses whether the droplets 68 are in the proper line relative to the target location 76. Although not particularly shown, known EUV radiation sources employ detectors that determine whether the droplets 68 are being vaporized properly at the desirable location. Therefore, the system would include feedback to insure that the droplets 68 are being directed to the target location 76.

The position of the sensor 84 is shown at a location after the stream 66 has been deflected by the steering plate 74. However, this is by way of a non-limiting example, in that the sensor 84 can be positioned at any convenient location along the path of the stream 66. For example, the sensor 84 can be positioned between the droplet generator 52 and the steering plate 74. Further, multiple steering plates and multiple sensors can be provided in other designs.

The steering plate 74 is shown in FIG. 2 redirecting the stream 66 of droplets 68 about 90°. In other designs, the orientation of the droplet generator 52 relative to the primary optics 80 can provide a minimal amount of deflection of the stream 66 to provide the proper orientation. The present invention is intended to cover both minor and major direction changes of the stream 66 to correct for misalignment of the stream 66 for any reason. For example, the droplet generator 52 and associated hardware may be so cumbersome that it is difficult to get it properly oriented to the laser beam 78. The steering plate 74 can be used to make minor adjustments to the stream 66 to provide fine tuning. Further, for whatever reason, the direction of the droplets 68 from the droplet generator 52 may change from time to time. The steering plate 74 can also be used to continually correct for the direction of the stream 66, possibly on a drop by drop basis.

The steering plate 74 can be any solid surface or plate suitable to deflect a frozen material. The steering plate 74 can be small and lightweight, to allow for high frequency steering as well as DC pointing. Because the droplets 68 are frozen, they bounce quasi-elastically off of the steering plate 74. Mounting the steering plate 74 to a tip/tilt actuator allows full steering flexibility and greatly reduces the alignment requirements with higher mass droplet generator systems. Additionally, high frequency translation of the steering plate 74 along the axis of the incident stream 66 can be used to introduce a variation in the total flight distance which counteracts for lasting variations in the droplet generator 52.

The actuator 88 can be any high or low frequency actuator suitable for the various EUV source applications. High frequency steering response can be obtained using a galvanometer, voice coil, piezo-electrically driven actuators or MEMS type mirrors. The actuator 88 can be any suitable commercial off-the-shelf component, such as those used in conventional optical fast steering mirrors. Examples of such devices include, but are not limited to, actuators available from Ball Aerospace, GSI Lumonics, Piezosystems, and Applied MEMS.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. An extreme ultraviolet (EUV) radiation source, comprising:

a droplet generator, said droplet generator generating a stream of droplets along an initial path;

a steering device having a solid surface steering plate that deflects, said steering device deflecting the droplets from the initial path to a target path;

a sensor sensing the position of the stream of droplets;

an actuator responsive to a signal from the sensor, said actuator causing the orientation of the steering plate to change so that the droplets are deflected to a target location on the target path; and a laser source generating a laser beam that is directed toward the target location.

2. The source according to claim 1 wherein the actuator is n actuator selected from the group consisting for galvanometers, voice coils, piezoelectric drivers, and MEMS devices.

3. The source according to claim 1 wherein the sensor is positioned relative to the initial path prior to the droplets being deflected by the steering device.

4. The source according to claim 1 wherein the sensor is positioned relative to the target path after the droplets have been deflected by the steering device.

5. The source according to claim 1 wherein the droplets are frozen when they are deflected by the steering device.

6. The source according to claim 5 wherein the droplets are xenon.

7. The source according to claim 1 wherein the initial path and the target path are about 90° relative to each other.

8. The source according to claim 1 further comprising primary optics, said target location being at the focal point of the primary optics.

9. An extreme ultraviolet (EUV) radiation source comprising:

a droplet generator, said droplet generator generating a stream of frozen droplets along an initial path;

a solid surface steering plate, said steering plate being positioned in the initial path and deflecting the droplets from the initial path to a target path;

a sensor positioned along the target path, said sensor sensing the position of the stream of droplets;

an actuator responsive to a signal from the sensor, said actuator causing the orientation of the steering plate to change so that the droplets are deflected from the steering plate to a target location on the target path; and a laser source generating a laser beam that is directed toward the target location.

10. The source according to claim 9 wherein the actuator is an actuator selected from the group consisting of galvanometers, voice coils, piezo-electric drivers and MEMS devices.

11. The source according to claim 9 further comprising primary optics, said target location being at the focal point of the primary optics.

12. The source according to claim 9 wherein the initial path and the target path are about 90° relative to each other.

13. The source according to claim 9 wherein the droplet generator generates frozen xenon droplets.

14. A method of generating extreme ultraviolet (EUV) radiation comprising:

generating a stream of droplets directed along an initial path;

deflecting the droplets off of a steering device, having a solid surface steering plate, from the initial path to a target path;

sensing the position of the stream of droplets;

adjusting the direction the droplets are deflected from the steering device by causing the orientation of the steering plate to change based on the sensed position of the stream of droplets; and generating a laser beam that is directed toward a target location.

15. The method according to claim 14 wherein sensing the position of the stream of droplets includes sensing the position of the stream of droplets prior to the droplets being deflected.

16. The method according to claim 14 wherein sensing the position of the stream of droplets includes sensing the position of the stream of droplets after the droplets have been deflected.

17. The method according to claim 14 wherein generating the stream of droplets includes generating a stream of frozen droplets.

18. The method according to claim 17 wherein the frozen droplets are xenon droplets.

* * * * *